United States Patent [19]

Burgess

[11] 4,348,614

[45] Sep. 7, 1982

[54] NON-LIGHT PRODUCING SUBSTITUTE APPARATUS FOR USE IN PLACE OF PHOSPHOR EXCITABLE LAMPS

[76] Inventor: David Burgess, 1341 W. 130th St., Gardena, Calif. 90247

[21] Appl. No.: 116,288

[22] Filed: Jan. 28, 1980

Related U.S. Application Data

[63] Continuation-in-part of Ser. No. 73,223, Sep. 7, 1979, Pat. No. 4,255,692.

[51] Int. Cl.[3] ..... H05B 41/16

[52] U.S. Cl. ..... 315/189; 315/228; 315/250; 315/324; 315/DIG. 5

[58] Field of Search ..... 315/119, 122, 126, 187–189, 315/191, 228, 250, 312, 324, DIG. 5

[56] References Cited

U.S. PATENT DOCUMENTS 2,637,833 5/1953 Skrotzki ..... 315/187

4,008,414 2/1977 Agnew ..... 315/324 X

*Primary Examiner*—Eugene R. LaRoche

*Attorney, Agent, or Firm*—Robert J. Schaap

[57] ABSTRACT

A non-light producing substitute apparatus for use as a replacement for a phosphor energizable lamp in an arrangement where a plurality of such lamps are connected in a series electrical circuit. Typically, two or more phosphor energizable lamps, such as fluorescent lamps, are connected to pairs of spaced apart sockets in a fixture and if one of the lamps is burned out or is removed, there is ineffective operation of the remaining lamp. The substitute apparatus permits one of the series connected lamps to be removed with the other to operate without substantially affecting lumen output of the remaining lamp and power factor loss. The substitute apparatus of the present invention is effective in that it does not necessarily create a connection between the two terminals in the pair of spaced apart sockets from which the lamp was removed. The substitute apparatus creates a grounding of the ballast or similar power generator or other power source which operates the fixture, or otherwise a ground plane in the fixture with respect to the sockets so that at least one of the sockets from which the lamp was removed is at the same ground potential as either the ballast or the ground plane of the fixture. Thus, a different electrical circuit path is established. Moreover, the substitute apparatus of the present invention is effective in that it is relatively small in its construction. The substitute apparatus comprises a relatively small tubular housing which is made of a plastic material and includes a power factor compensating element, such as a capacitor therein. The capacitor has one electrode thereof electrically connected to one of the terminals in the socket to which the lamp was previously connected and the other electrode of the capacitor is grounded. An adaptor may be used with and form part of the apparatus for grounding the terminal or terminals of the opposite socket from which the lamp was removed.

28 Claims, 16 Drawing Figures

NON-LIGHT PRODUCING SUBSTITUTE APPARATUS FOR USE IN PLACE OF PHOSPHOR EXCITABLE LAMPS

RELATED APPLICATION

This application is a continuation-in-part of my copending application Ser. No. 073,223 filed Sept. 7, 1979, now U.S. Pat. No. 4,255,692, issued Mar. 10, 1981, for Non-Light Producing Phosphor Energizable Lamp Simulator and Method of Using Same and Making Same.

BACKGROUND OF THE INVENTION

1. Field of the Invention

This invention relates in general to certain new and useful improvements in lamp substitutes as replacements for phosphor excitable lamps in plural lamp fixtures, and more particularly, to lamp substitutes of the type stated which are effective to replace an operating lamp in a plural lamp fixture without materially affecting operation of the remaining lamp or lamps.

2. Brief Description of the Prior Art

In recent years, there has been an interest in reducing the number of fluorescent lights in multi-fluorescent lamp fixtures in order to reduce energy requirements. The same holds true with the phosphor energizable lamp fixtures such as the fixtures which operate with the so-called cathode discharge lamps. For example, in many office buildings and other forms of commercial installations, it has been found that one or more of the lamps in a multi-lamp fixture can be removed without appreciably reducing the total light output so that inefficiency and eye fatigue does not result. In other words, many commercially available fixtures were constructed so that an excess of light was generated for a given purpose.

Conventional fluorescent lamp fixtures were often constructed to hold and energize two lamps. The ballast and circuitry were designed so that each of said lamps were 180 degrees out of phase. In this way, flicker was canceled out to some extent. Thus, two lights were employed or otherwise lights in pairs were employed to reduce noticeable effects of flicker even though the extra lumen output was not required.

One of the problems involved in removing a lamp, as for example, a fluorescent lamp, from a two lamp fixture was the fact that the ballast was not effective to operate only one of the lamps. Thus, in a two-lamp fixture where a ballast was provided, and one of the lamps was burned out, the other of the lamps would not operate or otherwise operated inefficiently with an excess of power.

In order to obviate these problems, there has been a proposed capacitive operable device which was connected between the terminals of a fluorescent lamp which has been removed in a two fluorescent lamp fixture. This device had an outer body with end caps thereon with the overall size and shape of the lamp it was replacing. The end caps were adapted to comply with sockets on the fixture much in the same manner as the removed bulb. A capacitor was connected between the two end caps internally within the outer body. In this way, the remaining lamp could operate without a substantial loss of lumen output and also minimizing the power factor deterioration. This system is more fully described in U.S. Pat. No. 3,956,665 to Westphal.

Another prior art system for permitting removal of one of the fluorescent lamps in a multi-lamp fixture and using a device connected to the sockets where the lamp has been removed is more fully described in U.S. Pat. No. 4,053,811 to Abernathy. In this case, a non-reactive lamp circuit was employed. However, the device also employed a body with a size and shape similar to the lamp to be removed.

While the devices in each of the aforesaid patents employed a tube with end caps and a terminal, they also suffered from the very substantial disadvantage that they could not be easily repaired. For example, these prior art devices were not designed in a manner where end caps could be easily removed for replacement of the wire or the capacitor if the need should arise, and they were not made of a non-breakable material.

In the various prior art substitutes as for example, the type illustrated in the Westphal patent and the type illustrated in the Abernathy patent, the wire extending across the tube could actually be seen. Any vibration in the room would cause the wire to vibrate and which was highly noticeable to an observer. Moreover, an observer looking at the lamp substitute device almost inevitably noticed a vibration of the wire extending across the lamp substitute in these prior art devices which was rather distracting.

The prior art lamp simulators were all constructed of glass, primarily due to the fact that the glass was made to a pre-cut size for use in the existing fluorescent lamp. Moreover, glass was used in these prior art devices due to the fact that plastic materials would tend to sag when constructed in lengths of six foot or greater. Another significant problem with the prior art lamp simulators is the fact that the construction was quite similar to that of an existing fluorescent lamp, even though it did not have the appearance of an existing fluorescent lamp. As a consequence, the end caps had a dimetral size which was slightly less than the actual size of the bulb itself. At least for purposes of shipment, each individual lamp simulator had to be thereafter shipped in a larger container. This of course materially added to the cost of production and distribution and hence the overall cost of a simulator.

Another one of the problems with these prior art devices is the fact that it was necessary to provide a tube, generally in the shape of the lamp which was removed and which should have end caps with terminals to fit within the sockets of the fixture much in the same manner as the removed lamp. Thus, it was necessary to construct a simulator which actually appeared somewhat similar to that of a lamp which was removed. Not only does this type of construction materially add to the overall cost of the simulator, but it also materially added to cost of shipping.

The present invention obviates these and other problems in the provision of a substitute apparatus for a lamp where a plurality of phosphor excitable lamps are connected in series and which substitute apparatus creates a different current path through the fixture. This enables the substitute apparatus to be of a relatively small size constructed at a low cost and easily packaged for purposes of storage and transportation.

OBJECTS OF THE INVENTION

It is, therefore, a primary object of the present invention to provide a substitute apparatus for a phosphor excitable lamp removed from a series arrangement of a plurality of such phosphor excitable lamps such that a new circuit path is created by using the substitute apparatus and which substantially minimizes any power factor loss and still effectively maintains substantially the same lumen output of the remaining lamp or lamps.

It is another object of the present invention to provide a phosphor excitable lamp substitute apparatus of the type stated which is constructed with a relatively small length so that it is not necessary to extend between and fit within the sockets of a fixture from which a light producing lamp had been removed.

It is a further object of the present invention to provide a substitute apparatus for a phosphor excitable lamp of the type stated which can be formed with a housing extruded from a plastic material at a relatively low cost and which is relatively non-breakable in its construction.

It is an additional object of the present invention to provide a method for removing at least one light producing phosphor excitable lamp in a series arrangement of such lamps and substantially minimizing power factor loss as well as substantially maintaining the same lumen output from each remaining lamp or lamps by using a substitute apparatus which creates a different circuit path.

It is still another object of the present invention to provide a lamp substitute of the type stated which effectively grounds either a ground plane of the fixture which carries the lamp, or a ballast circuit, which thereby improves the safety factor thereof.

It is an additional object of the present invention to provide a lamp substitute of the type stated which comprises a housing and in which a power factor compensating element such as a capacitor can be physically mounted on one of the end caps thereof and electrically connected to a ground terminal means on the housing and which facilitates easy replacement and repair.

It is also an object of the present invention to provide a lamp substitute of the type stated in which end caps on the housing are constructed with an overall diametral size larger than the housing such that a plurality of the devices can be packaged in an individual container without each being pre-packaged.

With the above and other objects in view, my invention resides in the novel features of form, construction, arrangement, and combination of parts presently described and pointed out in the claims.

BRIEF SUMMARY OF THE DISCLOSURE

The present invention provides a non-light producing substitute apparatus for phosphor excitable lamps such that the substitute apparatus can be used in the place of a removed phosphor excitable lamp in a series connection of such lamps. Typically, these phosphor excitable lamps are mounted in the sockets of a fixture in which two or more of such lamps are generally physically retained. Moreover, these lamps are oftentimes electrically connected in a series arrangement and more often are energized with signals out of phase in order to obviate problems of visible flicker.

A problem arises when it is necessary or desirable to remove one of the lamps from the circuit. The substitute apparatus of the present invention can be connected in such manner that it establishes a different electrical path than the path that was established through the lamp which was removed and for which the substitute was replaced. In the lamp substitute apparatus provided herein, the apparatus includes at least a lamp substitute device which is of a relatively small size and has a length which is substantially less than the distance between the sockets from which the lamp was removed. Moreover, the substitute device includes a power factor compensating element, such as a capacitor, which is mounted within the housing and is adapted to have one electrode thereof operatively electrically connected to one of the sockets from which the lamp was removed. In addition, a ground conductor is connected to another electrode of this power factor compensating element and is adapted to be grounded to the same ground potential as the fixture.

In another embodiment of the invention, the lamp substitute device comprises an end cap on each of the opposite ends of the housing. Moreover, a terminal means is located on one of these end caps and is capable of being fitted into the connector which receive the terminals of the phosphor excitable lamps. This terminal means is connected to one electrode of the power factor compensating element.

In a further embodiment of the invention, the power factor compensating element is a capacitor as aforesaid, and this capacitor may be physically mounted on one of the end caps for electrical connection to the terminal means on the end cap.

In the preferred embodiment of the invention, the lamp substitute apparatus constitutes a replacement for a fluorescent lamp. In this case, the end caps are similar to the end caps used on a fluorescent tube and moreover, the housing of the substituted device is of a tubular construction. In another embodiment, the housing is preferably formed of a non-breakable plastic material. Even further, the plastic material may be of a thin-walled construction and provided with an irregular interior surface, such as a plurality of splines on the interior surface of the housing. In this way, increased strength is imparted to the thin-walled construction of the tube forming part of the housing.

In still another embodiment, the lamp substitute apparatus may comprise an assembly which includes the lamp substitute device and an adapter to fit within the opposite socket of each pair of sockets to render all of the electrodes in that opposite socket at the same electrical potential. More specifically, this adapter actually creates a short and thereby grounds either the ballast or the ground plane forming part of the fixture. This adapter is desirable in some circuit arrangements, as for example, in the so-called rapid start circuit arrangement. It could also be used in some of the so-called instant start circuit arrangements.

The present invention could also include as part of the apparatus, a conductor which serves as a ground conductor and which may be physically connected to the ground plane of the fixture as aforesaid, or otherwise to the ballast and particularly the core portion of the ballast.

In one of the more preferred embodiments, the housing of the substitute device is formed of a plastic material as aforesaid and is comprised of an elongate tubular wall with the lengths substantially less than the distance between the sockets. An end cap is secured to and encloses each of the open ends of the lamp substitute housing. The end cap comprises an end wall which extends across the open transverse ends of this lamp substitute housing and a continuous annularly extending flange projecting from the end wall and engaging the end portions of the tubular wall. In this way, the flange has a greater diameter than the tubular wall at that portion of the tubular wall such that the flange extends outwardly of any portion of the tubular wall. In this way, a plurality of these lamp substitute devices can be packaged in an individual container with the end caps of one substitute device housing abutting against the end caps of another substitute device housing. Thus, it is not necessary to pre-package each individual substitute device for purposes of shipment and transportation.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
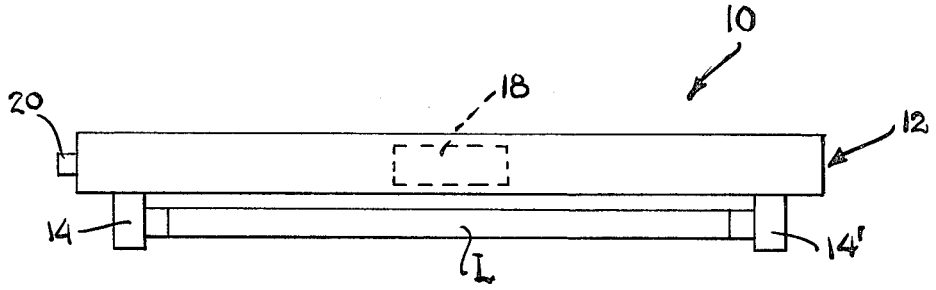
Figure 2:
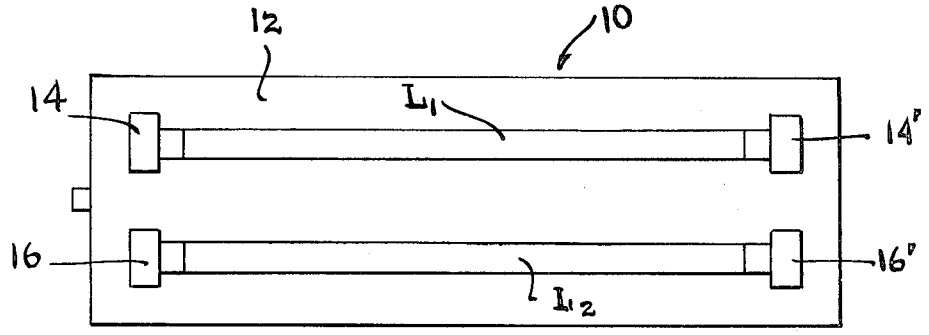
Figure 4:
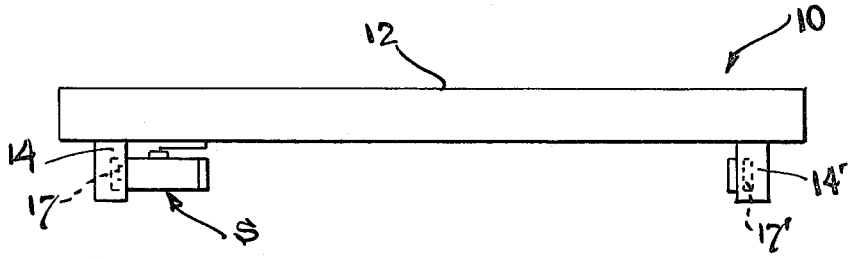
Figure 3:
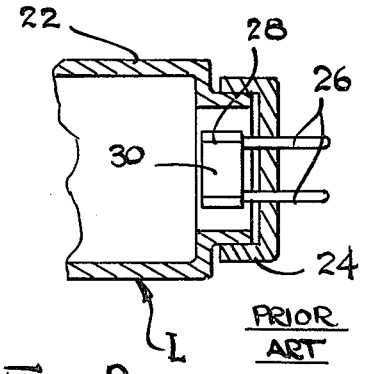
Figure 6:
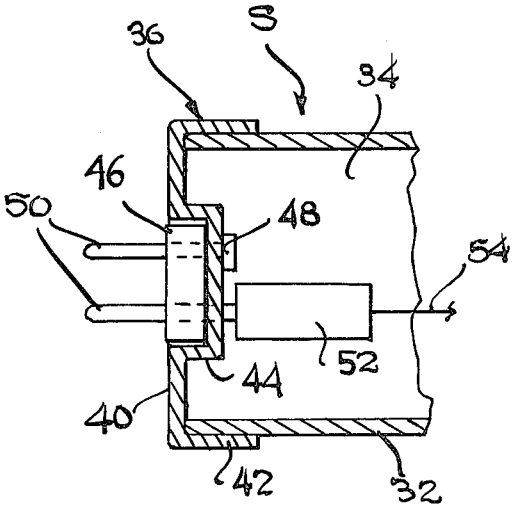
Figure 5:
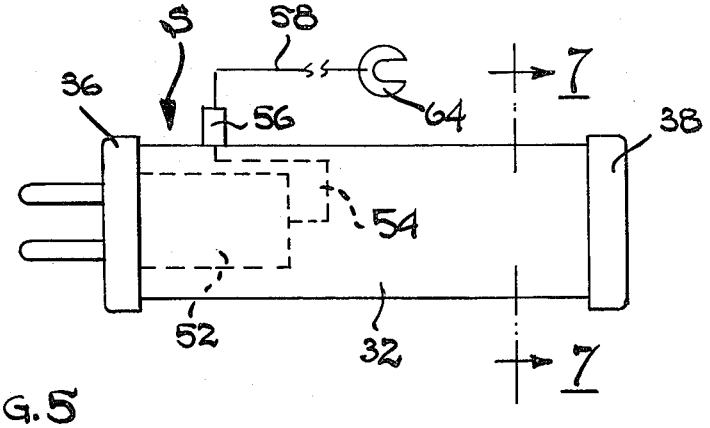
Figure 7:
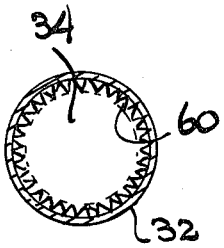
Figure 8:
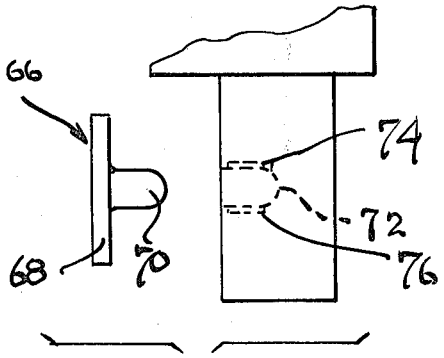
Figure 9:
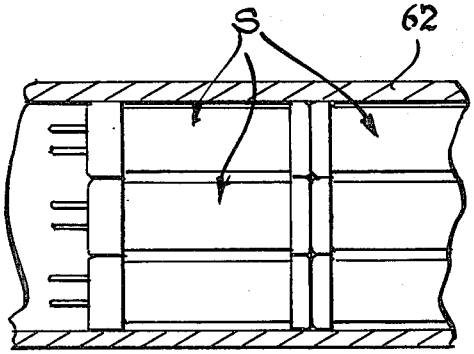
Figure 11:
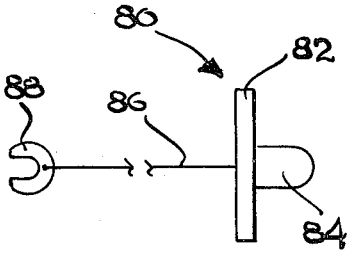
Figure 10:
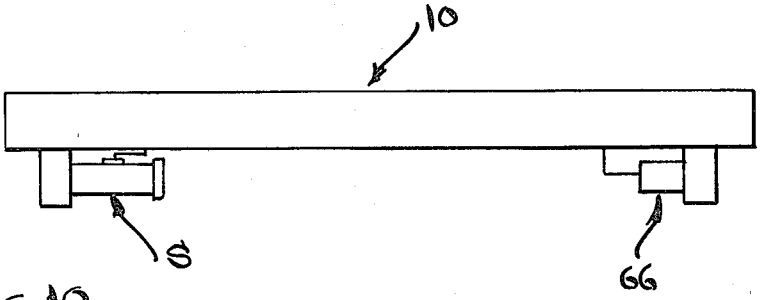
Figure 13:
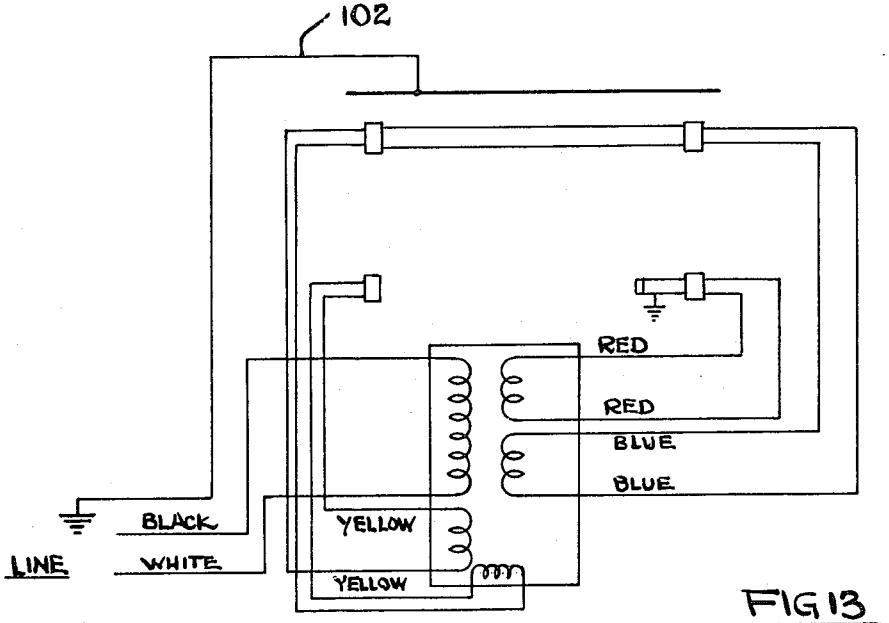
Figure 12:
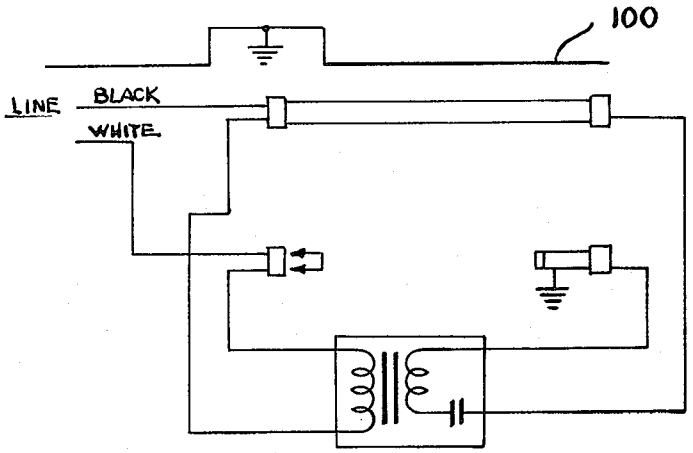
Figure 14:
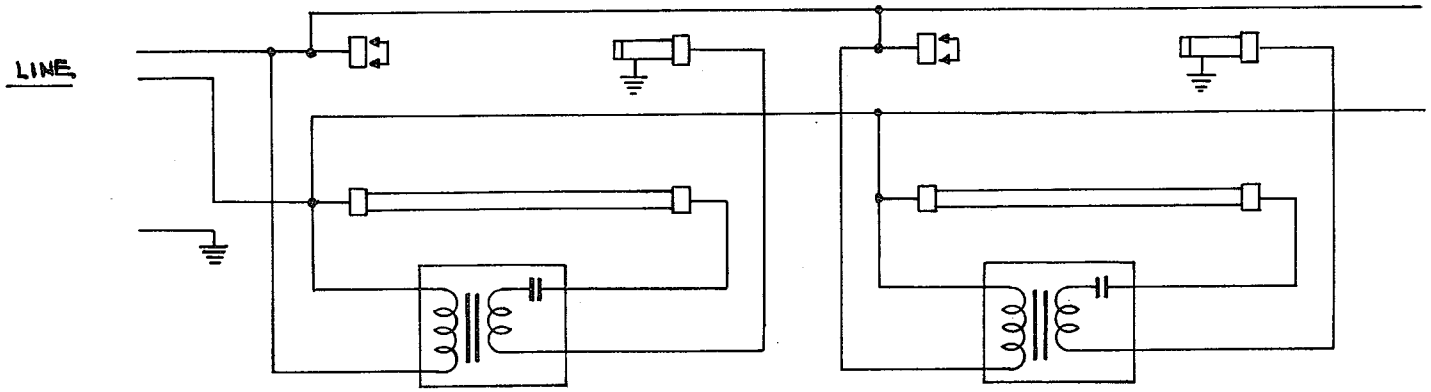
Figure 15:
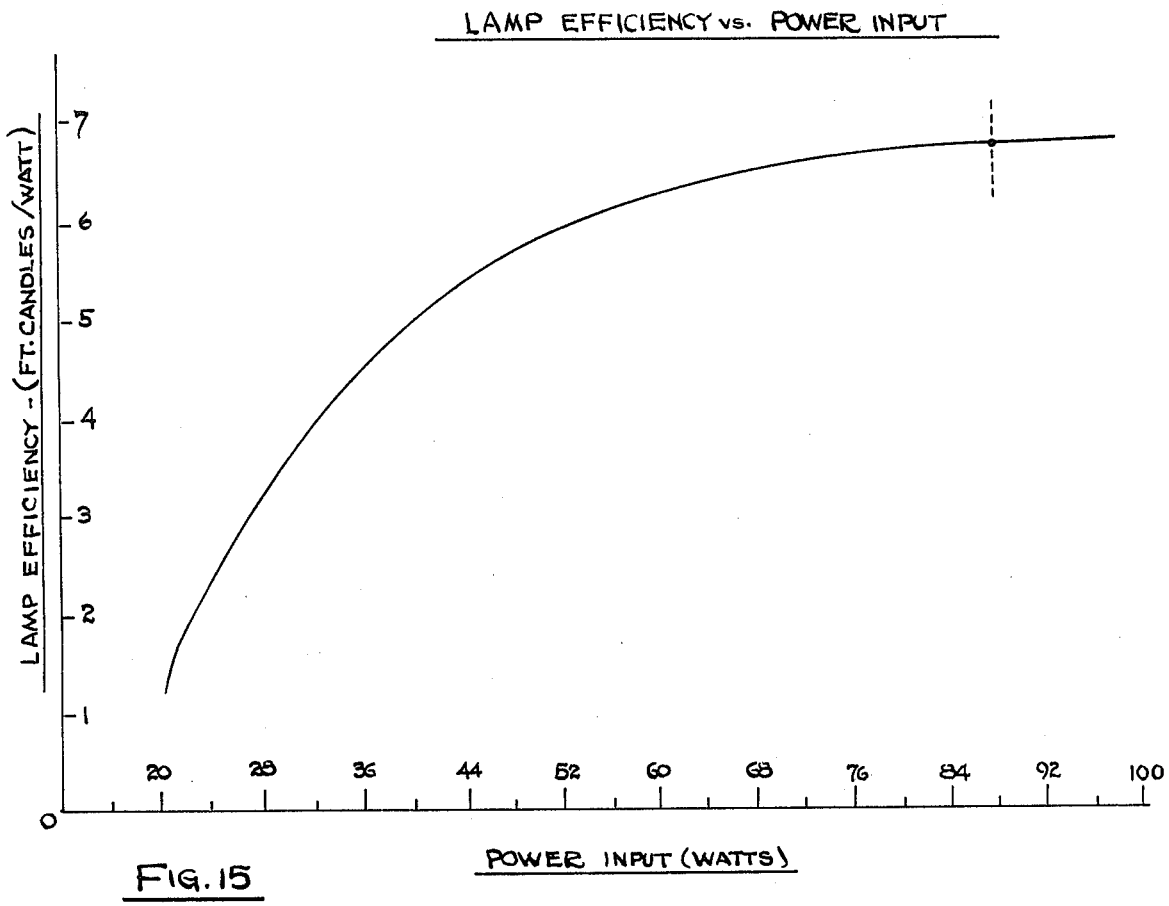
Figure 16:
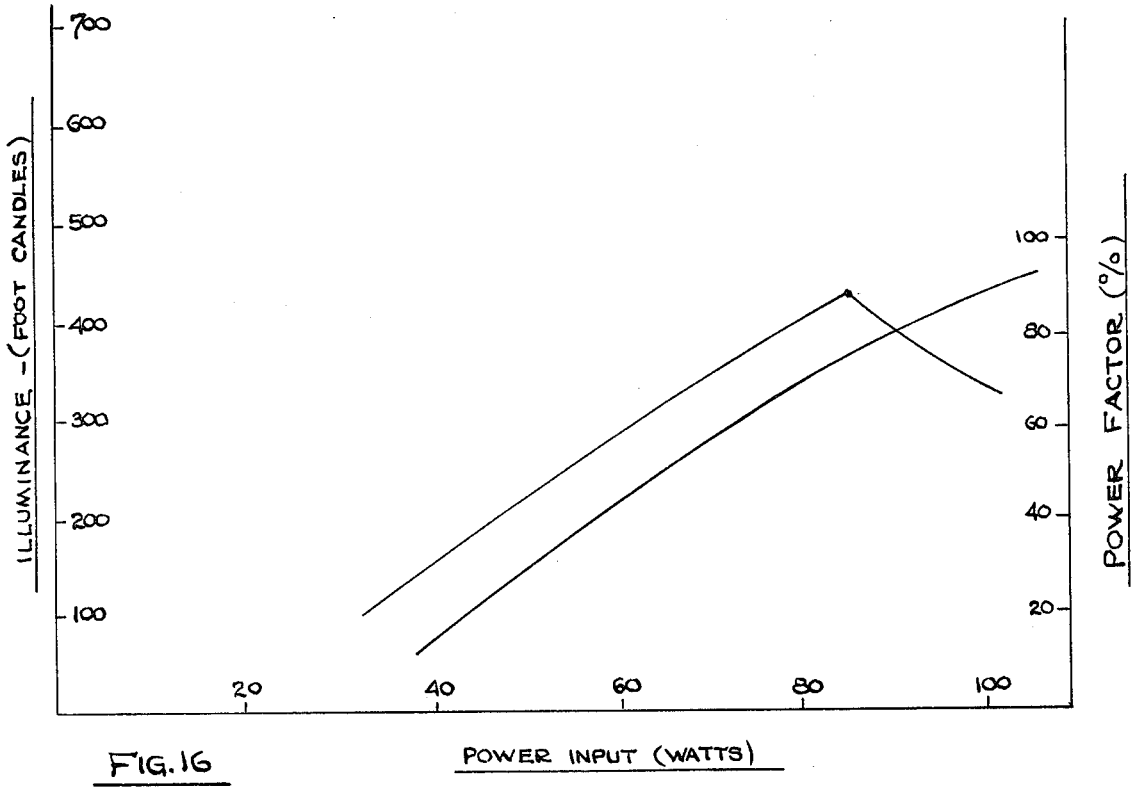

Having thus described the invention in general terms, reference will now be made to the accompanying drawings in which:

FIG. 1 is a side elevational view of a conventional light fixture with a pair of phosphor excitable lamps mounted in the sockets thereof;

FIG. 2 is a bottom plan view of the fixture of FIG. 1 and showing a pair of phosphor excitable lamps mounted in the sockets thereof;

FIG. 3 is a fragmentary partial sectional view showing the construction of a conventional prior art phosphor excitable lamp;

FIG. 4 is a side elevational view somewhat similar to FIG. 1, and showing a lamp substitute apparatus of the present invention replaced for one of the phosphor excitable lamps;

FIG. 5 is an enlarged side elevational view showing one of the lamp substitute apparatus of the present invention;

FIG. 6 is a fragmentary sectional view showing a portion of the end construction of one lamp substitute apparatus of the present invention;

FIG. 7 is a vertical sectional view taken along line 7—7 of FIG. 5;

FIG. 8 is a side elevational view, partially in section, and showing an adapter used with the apparatus including the lamp substitute device of the present invention for insertion in the opposite socket of a removed lamp;

FIG. 9 is a fragmentary side elevational view showing a plurality of the lamp substitute devices pacakged in a container in accordance with the present invention;

FIG. 10 is a side elevational view of a fixture with one operating lamp removed and replaced by the apparatus comprised of the lamp substitute device and an adapter used therewith;

FIG. 11 is a side elevational view of the form of adapter used in the embodiment of FIG. 10;

FIG. 12 is a schematic electrical circuit view showing the altered electrical arrangement when a lamp substitute apparatus of the invention is used in place of a light emitting lamp in a so-called "instant start" circuit arrangement;

FIG. 13 is a schematic electrical circuit view showing the altered electrical circuit arrangement when a lamp substitute apparatus of the present invention is used in place of a light emitting lamp in a so-called "rapid start" circuit arrangement;

FIG. 14 is a schematic view of a circuit arrangement similar to FIG. 12 and showing lamp substitute apparatus of the present invention used therein in a pair of connected fixtures;

FIG. 15 is a graphical illustration showing the lamp efficiency versus the power input obtained with the lamp substitute devices of the present invention; and FIG. 16 is a graphical illustration showing the illuminance versus the power input for an existing lamp when used in conjunction with a lamp substitute device of the invention.

DETAILED DESCRIPTION OF PREFERRED EMBODIMENTS

Referring now in more detail and by reference characters to the drawings which illustrate practical embodiments of the present invention, FIGS. 1 and 2 show a conventional fixture 10 of the type which holds and permits energization and lumen output from phosphor excitable lamps.

The fixture 10 is generally provided with an outer housing 12 having a generally rectangular shape as illustrated. Moreover, depending from a bottom wall of the housing 12 are two pairs of connector plates 14 and 14' and 16 and 16' as more fully illustrated in FIG. 2 of the drawings. Each of the connector plates are provided with sockets of the type normally found in conventional fluorescent light fixtures. Thus, for example, the connector plates 14 and 14' are provided with sockets 17 and 17' respectively. Moreover, these sockets are typically bayonet type sockets and include conductors therein for creating an electrical circuit through a phosphor excitable lamp such as a fluorescent lamp L.

Also normally included within the housing 12, although it may be located elsewhere, is a conventional ballast 18. The ballast is electrically connected to the sockets in the connector plates 14 and 14' as well as the connector plates 16 and 16'. Various circuit arrangements may be employed as for example, the so-called "instant-start" circuit arrangement or the so-called "rapid-start" circuit arrangement. In any event, the fixture is generally designed so that two phosphor excitable lamps designated as $L_1$ and $L_2$ in FIG. 2 are connected in a series relationship with respect to either the ballast 18 or other power source. In like manner, the fixture may be provided with a conventional fuse cap 20 for retaining a fuse in the electrical circuit including the ballast 18.

The typical fluorescent lamp is only one embodiment of a phosphor excitable lamp. The fluorescent lamp is also a gaseous discharge lamp of a conventional construction, and one of such lamps L is more fully illustrated in FIG. 3 of the drawings. The typical fluorescent lamp comprises a bulb 22, which is shown as having a straight glass tube, although the tube often adopts other shapes, as for example, a circular shape, or the like. One end of the tube 22 is provided with a non-conductive base or cap 24 having a plurality (two as shown) of electrical terminals 26. These terminals, which are often referred to as "base pins", are connected to lead-in wires 28 located internally within the tube, and the lead-in wires are located in a so-called "stem press" 30 constructed of a material to assure the same coefficient of expansion as the glass tube 22. The lead-in wires 28 are connected to a cathode which may adopt the form of a "hot cathode" which is designed to ignite a gas in the tube as hereinafter described. The cathode is coated with an emissive material which emits electrons and is usually made of a coil, e.g., a simple coil tungsten wire. In many commercial embodiments, a pair of similar cathodes and related structure would be included at each end of the glass tube 22.

The inside of the bulb or tube 10 is provided with a phosphor coating which transforms ultraviolet radiation into visible light. The color of the light often depends on the composition of the phosphor. A minute amount of mercury is also located in the bulb to furnish the mercury vapor for purposes of ignition. In addition, an inert gas, such as argon, krypton, and the like, may be used. The coating on the hot cathode is generally formed of an emissive material such as barium, strontium, calcium oxide, or the like, and which emits electrons when heated to an operating temperature of about 950 degrees C. After the cathode has been heated to the proper temperature, thermionic emission will occur. The emitted electrons, upon collision, will release ultraviolet radiation which is converted into visible light by the phosphors.

A lamp substitute may also be provided for an electroluminescent lamp in the present invention. The conventional electroluminescent lamp is comprised of a plastic plate which is translucent and preferably transparent in its concentration. Applied to one surface of this plate is a phosphor coating and disposed against the phosphor coating is a metal sheet such as an aluminum sheet. Conductors are attached to the phosphor coating and the metal sheet. These conductors are adapted for connection to a suitable source of current through a ballast, and in the case of the present invention, would be connected to inputs of the generator. The electroluminescent lamp operates on essentially the same principle as the gaseous discharge lamp. However, in this case, the phosphors are not located in a tube or bulb. The electroluminescent lamp operates with a very high frequency creating a capacitive effect across the phosphor coating and the metal sheet with the phosphors converting the ultraviolet radiation into visible light radiation.

FIG. 4 illustrates the Fixture 10 of FIGS. 1 and 2, with one of the normal operating lamps, such as the lamp $L_1$, removed therefrom and with a substitute apparatus of the present invention used in place of the removed lamp. The substitute apparatus, in this embodiment, comprises a lamp substitute device S inserted into one of the sockets 17. One such substitute device is more fully illustrated in FIGS. 5–7 of the drawings.

The substitute device S comprises a tubular housing 32 with a shape which may be circular in cross section, similar to that of a typical fluorescent tube. Moreover, the housing 32 may have a diameter approximately similar to that of a conventional fluorescent tube. The housing 32 has a hollow interior 34 and is provided at each of its transverse ends with end caps 36 and 38. While the housing may have an overall cross section size somewhat similar to a conventional fluorescent lamp, the end caps 36 and 38 do not necessarily have an appearance and size and shape similar to that of the end caps of a normal fluorescent lamp as hereinafter described. Moreover, the housing 32 is relatively short and may only have a length of a few inches whereas a conventional fluorescent lamp may have a length of forty-eight inches, seventy-two inches, or more.

One preferred construction of the end cap 36 is more fully illustrated in FIG. 6 of the drawings and may adopt a construction somewhat similar to an end cap normally used in fluorescent lamps, as hereinafter described. However, the end cap 38 comprises a relatively flat wall and annularly extending rim since it normally would not be provided with terminals or provide any electrical connection.

Each of the end caps 36 is provided with a relatively flat outer wall 40 having an integrally formed annularly extending end flange 42 which engages the exterior surface at the periphery of the transverse end of the housing 32. Moreover, the end flanges 42 may be secured to the end portions of the tube housing 32 by means of an adhesive or the like.

The relatively flat end walls 40 of the end caps 36 are provided with recessed sections 44 and fitted within the recessed sections 44 of each end cap is an insert 46, preferably formed of a dielectric material. Moreover, a pair of contacts 48 are formed on the inner surface of the dielectric material 46 of each end cap. In addition, a pair of terminals 50 on each end cap extend outwardly through the insert 46 and are connected to the contacts 48. Only one of the contacts 48 is shown in FIG. 6.

The terminals 50 are designed to fit within the slots of a conventional socket-type connector in a conventional fluroescent lamp fixture. In many cases, some fluorescent lamps are designed with only one terminal on each of the end caps and again, the present invention contemplates any form of terminal means which is conventional in the art. Thus, the illustrated device could be used with any form of terminal arrangement on the end caps, as for example, the so-called "single pin", "medium-bi-pin" or "recessed double contact."

Located within the housing 32 is a power factor compensating element 52, such as a conventional capacitor. The capacitor itself could be located anywhere in the housing, although in one of the preferred embodiments, the capacitor 52 or other form of power factor compensating element is secured to one of the end walls of the cap 36 or 38. In this case, the capacitor could have one of its electrodes directly soldered to one of the contacts 48, in the manner as illustrated in FIG. 6. The other electrode of the capacitor 52 is connected through a conventional conductor 54 to a terminal 56 on the exterior of the housing 32 in the manner as illustrated in FIG. 5. This terminal 56 is designed to connect to a ground wire such as the ground wire 58 in the manner as also illustrated in FIG. 5.

The light substitute device of the present invention creates a different circuit path which does not form a path or connection through the pair of sockets from which the light emitting lamp was removed. In this respect, it can also be observed that the end cap 38 is not provided with any terminals as such inasmuch as it does not connect to the opposite socket. Thus, referring to FIG. 4, it can be observed that only the terminals on the end cap 36 are connected to the connector plate 14 and the lamp substitute device S is not connected to the socket in the end cap 14'. The details of the circuit alteration are hereinafter described in more detail.

The housing itself is preferably made of a plastic material, and preferably a styrene. In this way, the housing is not only non-breakable, in the manner as glass, but also has many other advantages in that it can be easily extruded at a relative low cost. Thus, in the production of the lamp substitute device, it is only necessary to provide an extruded tube with this ribbed or splined effect on the interior and apply the end caps thereof, much in a snap-fitting arrangement. Further, extrusion is facilitated since the lamp housings have a relatively constant cross sectional size and shape over their length.

In one embodiment of the invention, the interior surface of the housing 32 may be provided with a plurality of either upstanding or recessed elements regularly spaced apart such as a plurality of spaced apart longitudinally extending ribs or ridges 60, in the manner as illustrated in FIG. 7. Inasmuch as the plurality of ribs are regularly spaced apart from each other, they appear as a plurality of splines and thus the serrated or ribbed effect can be referred to as a "splined effect". This is highly advantageous in that it lends to reduced cost of manufacture. The use of the grooves or ribs in the lamp substitute allows for a thin walled construction in the housing 32. In this way, it is possible to extrude the lamp housings at a fairly high rate and also on a very economical basis. Moreover, the thin walled construction along with the grooves or ribs provides the necessary degree of rigidity and strength.

The illustrated embodiment of the lamp substitute device is one of the more preferred since the lamp housing can be constructed at a low cost due to the fact that it has a relatively constant cross sectioned shape over its length. Moreover, by virtue of the fact that the end caps are slightly diametrally larger, a plurality of such devices can be packaged in a single container, designated as 62, and as shown in FIG. 9, without the necessity of individual paperboard liners or other liners or sleeves. Thus, only the end caps are abutted against each other as shown and the lamp housings are spaced apart from each other to prevent abutment and resultant abrasion. Further, by use of this construction breakage is reduced and shipping costs are substantially reduced.

FIG. 8 illustrates a grounding fitting, often referred to as an "adaptor," which may be used with the lamp substitute device S of the present invention. In this case, the fitting, designated by reference numeral 66, is comprised of a non-conductive plate such as a disc 68. Secured to one flat surface of the disc 68 is a metallic or similar electrically conductive plug 70. In this case, the plug 70 is designed to extend into a socket 72 which is conventionally provided in fixtures of the type, such as the fixture 10. Moreover, it can be observed that in the socket 72 there are provided a pair of spaced apart electrically conductive elements 74 and 76. Thus, by virtue of inserting the plug 70 into the socket 72, a direct electrical connection or "short" is made through the terminals 74 and 76. This type of shorting effectively creates a ground throughout another portion of the circuit.

Depending upon the particular circuit arrangement employed in the fixture, it may be desirable to use the fitting 66 in addition to the lamp substitute S. In many cases, however, again depending upon the particular circuit arrangement, it is not necessary to use this ground fitting.

In many cases, it is desirable to ground both sides of the circuit from which the light emitting lamp was removed; that is, to ground both of the sockets from which the lamp was removed. In this case, the lamp substitute device as heretofore described would be employed and would be connected to the fixture 10 as illustrated in FIG. 4, as well as in FIG. 10. For this purpose, the ground conductor 58 could be provided with a suitable prong type fitting 64. In this way, the lamp substitute is grounded to the fixture 10 and hence to the ground plane itself.

In an alternate embodiment, the present invention provides a grounding fitting or so-called "adaptor" 80 which is similar to the previously described fitting. The fitting 80 also includes a dielectric plate such as a disc 82 having a metallic or similar electrically conductive plug 84 and the latter of which is adapted to extend into a socket of the type illustrated in FIG. 8. Moreover, the fitting 80 is provided with a ground line 86 which is electrically connected to the plug 84 and is provided at its outer end with suitable conventional screw type fitting 88 in order to be affixed to the ground plane of the fixture 10 as aforesaid. This type of circuit connection is highly desirable in some cases in order to further reduce power factor loss and to maintain the same lumen output of the remaining lamps.

By virtue of grounding one of the sockets to the ground plane of the fixture, it has been found that it is actually not necessary to locate the operating bulb in close proximity to the ground plane. In other words, the remaining bulb in the fixture can be spaced at some distance from the ground plane and still operate efficiently. The exact theory behind the operation of the ground plane and the theory as to why substantial energy savings are achieved with the device of the present invention are not fully known. Nevertheless, it has been established that by connecting one of the sockets from which the operating lamp was removed to the ground plane, through a power factor compensating element, such as a capacitor, there is very little power factor loss and the remaining lamp may operate producing substantially the same lumen output.

Many of the ballasts are electrically insulated at least effectively, if not intentionally, from the ground plane due to the fact that they are painted and there is oftentimes no strong electrical connection to the core in the transformer of the ballast itself. Consequently, it is quite important to create an effective grounding at least to the ground plane when using the lamp substitutes of the present invention in some circuit configurations. Moreover, as indicated above, depending upon the particular circuit arrangement, it may also be necessary to effectively connect and thereby short circuit the socket opposite to the socket from which the lamp was removed and the substitute device inserted. Here again, the exact theory of operation is not understood, although tests have proved that the lamp substitute and fittings therefore are highly effective in the present invention.

FIG. 12 illustrates one particular circuit arrangement in which a lamp was removed from a two lamp fixture and where both lamps were initially connected in a series. This type of circuit arrangement represents the so-called "instant start circuit." Thus by further reference to FIG. 12, it can be observed that when one of the lamps is removed, a lamp substitute is connected to the right-hand socket and grounded. The grounding in this case is designated schematically, although it would be connected to the ground plane designated by reference numeral 100 in FIG. 12. Moreover, and in this particular circuit arrangement, a fitting is inserted into the socket of the left-hand end and this fitting is schematically represented by a pair of arrows showing an effective shorting through this left-hand socket. FIG. 13 illustrates a circuit arrangement representing the so-called "rapid-start" circuit. In this case, again a lamp in a two lamp fixture is removed and replaced by a lamp substitute in accordance with the present invention. In this particular case, it was found not to be necessary to use a ground fitting of the type illustrated in either FIG. 8 or FIG. 11. Moreover, it is again observed that a ground line is connected directly to the ground plane, as illustrated. In many cases, if the lamp fixture itself is not effectively grounded to an earth ground, as opposed to a floating ground, then a separate grounding line such as the grounding line 102 illustrated in FIG. 13 should be employed.

FIG. 14 illustrates an arrangement in which a lamp in each of two fixtures was removed and where the fixture normally included a pair of lamps connected in series. In this case, a lamp substitute device of the invention was connected in the right-hand socket where the lamps were removed, thereby permitting the remaining lamp in each fixture to effectively operate.

The lamp substitute apparatus of the present invention are highly effective in that they can be constructed at a relatively low cost as previously described. Moreover, they are easily disassembled by simple removal of the end caps for purposes of repair and cleaning. In addition, it is not necessary to insulate the conductor 54 located within the housing 32 since it is not generally exposed.

FIG. 14 ilustrates that arrangement in which one fluorescent lamp has been removed from each of two fixtures and a lamp substitute of the present invention substituted for the fluorescent lamp in each of said fixtures. The amount of wattage required in this arrangement to power the lamps was reduced to about 55 watts, resulting in savings of about 137.2 watts. The power factor in each case is about 93%. It can be observed that no rewiring, except for making a simple gound connection, is required and no special knowledge or electrical circuit ability is required to make the change. Moreover, in the arrangement where four fluorescent lamps are employed, the amount of amperes used was 1.6 for a measured period of time and for the same period of time with two lamp substitutes in place of two of the normal fluorescent lamps, only 0.46 amperes were required at 120 volts.

FIG. 15 illustrates a lamp efficiency obtained in a conventional two lamp fixture when one of the lamp substitutes of the present invention is substituted for one of the two light emitting lamps in such two lamp fixtures. It can be observed that the use of the lamp substitute of the present invention along with an existing lamp in a two lamp fixture obtained substantially equal efficiency to a fixture in which two energizable and illuminatable lamps were employed, while accomplishing a 71% reduction in total power input required. The light output in footcandles is reduced in luminance by only 46% compared to the luminance of one lamp isolated and operating in an unaltered circuit configuration.

The lamp substitutes of the invention and the adaptors which may be used therewith are designed to achieve a maximum power factor with the capacitative substitution, as illustrated. FIG. 16 shows the power factor on the right-hand side versus the input power in watts on the lower portion of the graph. The substitutes of the present invention obtain a peak power factor of 92% as illustrated in the curve designated as B. The curve designated as A is the luminance in footcandles as related to the power input. A light level of about 185 foot-candles on the curve A relates to the vertical dash line extending downwardly from the drop-off point on the power factor versus power input curve A. It can be understood that a projected design at greater power input would provide more luminance although efficiency would suffer considerably. Thus, the lamp substitutes of the invention are designed to achieve a maximum power factor.

Thus, there has been illustrated and described a unique and novel lamp substitute and adaptors therein as a replacement for a phosphor excitable lamp in a plural lamp fixture which minimizes power factor loss and which is relatively inexpensive to manufacture and repair. Thus, the present invention fulfills all of the objects and advantages sought therefore. It should be understood that many changes, modifications, variations, and other uses and applications will become apparent to those skilled in the art after considering this specification and the accompanying drawings. Therefore, any and all such changes, modifications, and other uses which do not depart from the spirit and scope of the invention are deemed to be covered by the invention which is limited only by the following claims.

Having thus described my invention, what I desire to claim and secure by letters patent is:

1. A lamp substitute as a replacement for a phosphor energizable lamp in a plural lamp fixture with a pair of spaced apart sockets for each lamp and adapted to receive end terminals on said lamps, said lamp substitute comprising:

(a) a housing having a length substantially less than the distance between said sockets, (b) a power factor compensating element in said housing and adapted to have one electrode operatively electrically connected to one of said sockets, and (c) a ground conductor connected to another electrode of said power factor compensating element and adapted to be grounded to the same ground potential as said fixture.

2. The lamp substitute of claim 1 further characterized in that (a) end caps are on each of the opposite ends of said housing, and (b) terminal means are located on at least one of said end caps and capable of being fitted into connectors which receive the terminals of a phosphor energizable lamp, said terminal means being connected to one electrode of said element.

3. The lamp substitute of claim 1 further characterized in that said element is a capacitor means.

4. The lamp substitute of claim 2 further characterized in that said element is a capacitor physically mounted on one of said end caps and being electrically connected to the terminal means on said end cap.

5. The lamp substitute of claim 2 further characterized in that said lamp substitute comprises part of an assembly which also comprises a conductor means for connecting said plural lamp fixture to a ground potential.

6. The lamp substitute of claim 1 further characterized in that said lamp substitute constitutes a replacement for a fluorescent bulb and said housing is a tubular housing.

7. The lamp substitute of claim 6 further characterized in that said tubular housing is formed of a relatively non-breakable plastic material.

8. The lamp substitute of claim 7 further characterized in that a plurality of splines are formed on the inside of said housing and extend for at least the major part of the axial length of said housing.

9. For use with a lighting fixture with two pairs of socket-type connectors adapted to have at least two phosphor energizable lamps respectively connected thereto, a non-illuminatable lamp substitute replaceable for one of the lamps in said fixture and permitting the other of the lamps to produce substantially normal lumen output with substantially normal power input to the operating lamp or lamps, said lamp substitute comprising:

(a) a lamp housing having a length substantially less than the distance between said connectors, (b) end caps on each of the opposite ends of said housing, (c) terminal means on at least one of said end caps capable of being fitted into one of the connectors which receive the terminal of a phosphor energizable lamp, (d) a power factor compensating element in said housing and having one electrode connected to the terminal means in the at least one of said end caps, and (e) a ground conductor connected to another electrode of said power factor compensating element and adapted to be grounded to the same potential as said fixture.

10. The lamp substitute of claim 9 further characterized in that said compensating element is a capacitor physically mounted on one of said end caps and being electrically connected to the terminal means on said end cap.

11. The lamp substitute of claim 9 further characterized in that said lamp substitute comprises part of an assembly which also comprises a conductor means for connecting said plural lamp fixture to a ground potential.

12. The lamp substitute of claim 9 further characterized in that said lamp substitute constitutes a replacement for a fluorescent bulb and said housing is a tubular housing.

13. The lamp substitute of claim 12 further characterized in that said tubular housing is formed of a relatively non-breakable plastic material.

14. The lamp substitute of claim 9 further characterized in that said substitute is part of an assembly which comprises an adaptor to fit within the opposite connector of each pair to render all electrodes in said opposite connector at the same electrical potential.

15. A lamp substitute as a replacement for a phosphor energizable lamp in a plural lamp fixture, with a pair of spaced apart sockets for each lamp and adapted to receive terminals on said lamp, said lamp substitute comprising:

(a) lamp substitute housing formed of a plastic material said housing having an elongate tubular wall with a length substantially less than the distance between said sockets, said housing having a pair of opposed transverse opened ends and having a relatively cross-sectional area across its length, (b) a separate end cap secured to and enclosing each of the open ends of said lamp substitute housing, each said end cap comprising:

(1) an end wall extending across the open transverse end of the lamp substitute housing, (2) a continuous annularly extending flange projecting from said end wall and snuggly engaging the end portion of the tubular wall at said transverse end such that the flange has a greater diameter than the tubular wall at that portion of the tubular wall such that the flange extends outwardly of any portion of said tubular wall, and (3) a terminal on the end wall of one of said caps and adapted to be electrically and physically connected to one of the sockets adapted to receive the terminal of a lamp, (c) an electrical power factor compensating element within said housing and being electrically connected to the terminal on said one end wall so as to be electrically connected to one of said sockets, and (d) a ground conductor connected to said element and extending outwardly of said housing and adapted to be grounded to the same ground potential as said fixture such that said substitute may replace an existing lamp in a plural lamp fixture and allowing the remaining lamp or lamps to produce substantially normal lumen output with substantially normal power input to the operating lamp or lamps.

16. The lamp substitute of claim 15 further characterized in that said electrical compensating element comprises a capacitor connected to said terminal.

17. The lamp substitute of claim 16 further characterized in that said capacitor is physically mounted on the end wall of one of said end caps.

18. The lamp substitute of claim 16 further characterized in that said lamp substitute comprises part of an assembly which also comprises a conductor means for connecting said plural lamp fixture to a ground potential.

19. The lamp substitute of claim 16 further characterized in that said lamp housing is provided with a plurality of closely spaced apart elements on the interior of said lamp housing and being located for at least the greater portion of the length of said housing to form an irregular interior surface effect.

20. The lamp substitute of claim 19 further characterized in that said spaced apart elements are generally spaced apart elongate ridges extending for the greater portion of the length of said housing.

21. The lamp substitute of claim 15 further characterized in that a plurality of the lamp substitutes are capable of being packaged in a container such that the end caps on each of the opposed transverse ends are in contact with end caps on immediately adjacent lamps and the lamp substitute housing is spaced from the lamp substitute housings on such immediately adjacent lamp substitutes.

22. A lamp substitute assembly to be substituted for one of a plurality of phosphor energizable lamps connected in series with respect to a ballast and located in proximity to a ground plane, said lamp substitute comprising:

(a) a housing, (b) a power factor compensating element in said housing compensation for power factor when one of said lamps is removed from said series arrangement, (c) means with said housing for grounding said compensating element, and (d) conductive means for grounding at least one of said ballast or said ground plane with the same potential as the compensating element.

23. The lamp substitute assembly of claim 22 further characterized in that one of said lamps is removed from a pair of spaced apart sockets and replaced by said housing, said substitute assembly creating a different circuit path and not through the socket from which said lamp was removed.

24. The lamp substitute assembly of claim 23 further characterized in that said power compensating element is a capacative means.

25. The lamp substitute assembly of claim 24 further characterized in that an end cap is located on said housing and said capacitor means is connected to a terminal on said housing for connection to one of the sockets from which said lamp was removed.

26. A method of removing a phosphor excitable light producing lamp in a series connection of two or more of such lamps and compensating for power factor loss by replacing such light producing lamp with a non-light producing lamp substitute, said method comprising:

(a) removing one of the light producing lamps from the sockets of a fixture which hold two or more of such lamps and where each lamp is held by a pair of spaced apart sockets and electrically connected to a ballast through such pair of sockets, (b) replacing the removed light producing lamp with a non-light producing lamp substitute having an outer housing and an end cap with a terminal adapted to connect to one of the sockets of the pair from which the lamp was removed, and (c) electrically connecting a power factor compensating element in said housing to said fixture to ground same, said compensating element being connected to the terminal of said end cap to thereby create an electrical circuit path through the socket in which said substitute is connected and through said compensating element to said fixture, and which circuit path is not through the pair of spaced apart sockets from which said light producing lamp was removed.

27. The method of claim 26 further characterized in that said method comprises producing substantially normal lumen output with substantially normal power input to the remaining light producing lamp.

28. The method of claim 27 further characterized in that said method comprises inserting an electrically conductive element in the other of the sockets of the pair which does not have the terminal of the end cap connected thereto.

* * * * *